United States Patent [19]

Herbst et al.

[11] Patent Number: 4,853,105

[45] Date of Patent: Aug. 1, 1989

[54] MULTIPLE RISER FLUIDIZED CATALYTIC CRACKING PROCESS UTILIZING HYDROGEN AND CARBON-HYDROGEN CONTRIBUTING FRAGMENTS

[75] Inventors: Joseph A. Herbst, Turnersville; Hartley Owen, Belle Mead, both of N.J.; Paul H. Schipper, Wilmington, Del.

[73] Assignee: Mobil Oil Corporation, New York, N.Y.

[21] Appl. No.: 148,204

[22] Filed: Feb. 1, 1988

Related U.S. Application Data

[63] Continuation of Ser. No. 903,182, Sep. 3, 1986, abandoned.

[51] Int. Cl.[4] ..... C10G 51/04

[52] U.S. Cl. ..... 208/74; 208/113; 208/72

[58] Field of Search ..... 208/153, 144, 145, 157, 208/74–78, 73, 111, 120

[56] References Cited

U.S. PATENT DOCUMENTS

| | | | |
|---|---|---|---|
| 2,905,607 | 9/1959 | Long et al. . | |
| 3,617,497 | 11/1971 | Bryson et al. | 208/80 |
| 3,758,403 | 9/1973 | Rosinski et al. | 208/120 |
| 3,894,932 | 7/1975 | Owen | 208/74 |
| 3,894,933 | 7/1975 | Owen et al. | 208/77 |
| 3,894,934 | 7/1975 | Owen et al. | 208/78 |
| 3,926,783 | 12/1975 | Wolk | 208/157 |
| 3,974,062 | 8/1976 | Owen | 208/74 |
| 4,035,285 | 7/1977 | Owen et al. | 208/120 |
| 4,419,214 | 12/1983 | Balint et al. . | |
| 4,422,925 | 12/1983 | Williams et al. | 208/75 |
| 4,427,539 | 1/1984 | Busch et al. . | |
| 4,436,613 | 3/1984 | Sayles et al. | 208/74 |
| 4,443,325 | 4/1984 | Chen | 208/55 |
| 4,490,241 | 12/1984 | Chou | 208/75 |
| 4,659,452 | 4/1987 | Howell . | |
| 4,676,887 | 6/1987 | Fischer et al. . | |
| 4,717,466 | 1/1988 | Herbst et al. | 208/113 |
| 4,749,470 | 6/1988 | Herbst et al. | 208/85 |
| 4,752,375 | 6/1988 | Herbst et al. | 208/74 |

FOREIGN PATENT DOCUMENTS

| | | |
|---|---|---|
| 0074501 | 3/1983 | European Pat. Off. . |
| 0101553 | 2/1984 | European Pat. Off. . |
| 0171460 | 2/1986 | European Pat. Off. . |
| 2298595 | 1/1975 | France . |

*Primary Examiner*—Glenn Caldarola

*Attorney, Agent, or Firm*—Alexander J. McKillop; Charles J. Speciale; Richard D. Stone

[57] ABSTRACT

A catalytic cracking process is provided which comprises:

(a) cracking a first heavy hydrocarbon feed in a first riser in the presence of a mixed catalyst composition comprising, as a first catalyst component, an amorphous cracking catalyst and/or a large pore crystalline cracking catalyst and, as a second catalyst component, a shape selective medium pore crystalline silicate zeolite, to provide gasoline boiling range material and one or more light hydrocarbons; and, (b) cracking a thermally treated second heavy hydrocarbon feed in a second riser in the presence of said mixed catalyst composition and in admixture with a gasiform material contributing mobile hydrogen species and/or carbon-hydrogen fragments at the reaction conditions employed to provide gasoline boiling range material in increased yield and/or of higher quality.

20 Claims, 1 Drawing Sheet

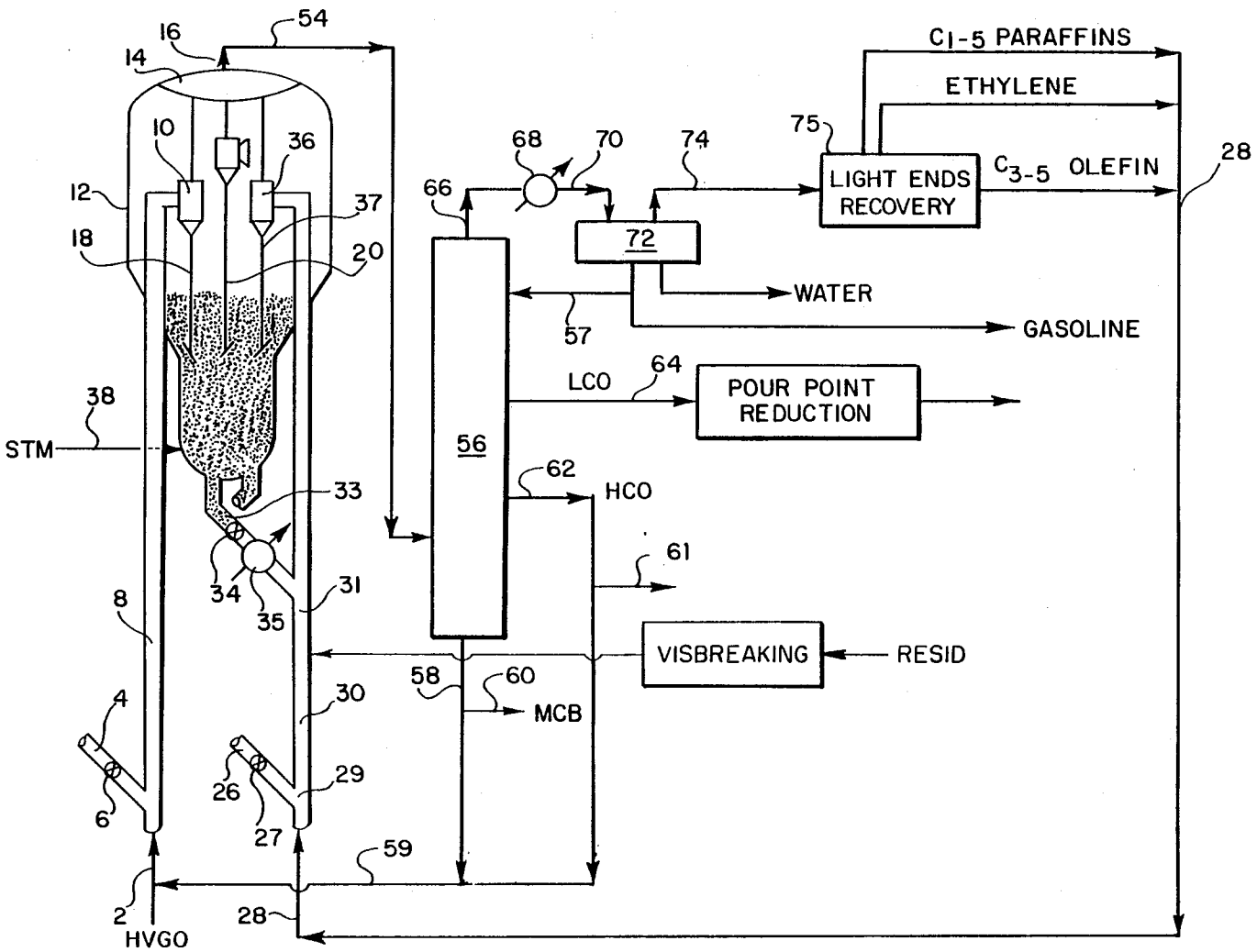
C1-5 PARAFFINS
ETHYLENE
C3-5 OLEFIN
LIGHT ENDS RECOVERY
WATER
GASOLINE
POUR POINT REDUCTION
RESID
VISBREAKING
HCO
LCO
MCB
HVGO
STM
56
72
28
75
74
70
68
66
57
64
62
61
60
58
59
54
16
14
10
12
18
20
37
36
33
31
30
29
35
34
27
26
8
4
6
2
38

MULTIPLE RISER FLUIDIZED CATALYTIC CRACKING PROCESS UTILIZING HYDROGEN AND CARBON-HYDROGEN CONTRIBUTING FRAGMENTS

This is a continuation of copending application Ser. No. 903,182, filed on Sept. 3, 1986, abandoned.

BACKGROUND OF THE INVENTION

This invention relates to a multiple riser catalytic cracking operation in which mobile hydrogen and/or carbon-hydrogen molecular fragments are employed to increase conversion of a hydrogen-deficient heavy hydrocarbon feed, e.g., a resid, to useful products contributing to gasoline boiling range material.

In known and conventional fluidized catalytic cracking processes, a relatively heavy hydrocarbon feedstock, e.g., a gas oil, admixed with a suitable cracking catalyst to provide a fluidized suspension is cracked in an elongated reactor, or riser, at elevated temperature to provide a mixture of lighter hydrocarbon products. The gasiform reaction products and spent catalyst are discharged from the riser into a separator, e.g., a cyclone unit, located within the upper section of an enclosed stripping vessel, or stripper, with the reaction products being conveyed to a product recovery zone and the spent catalyst entering a dense catalyst bed within the lower section of the stripper. In order to remove entrained hydrocarbon product from the spent catalyst prior to conveying the latter to a catalyst regenerator unit, an inert stripping gas, e.g., steam, is passed through the catalyst where it desorbs such hydrocarbons conveying them to the product recovery zone. The fluidizable catalyst is continuously circulated between the riser and the regenerator and serves to transfer heat from the latter to the former thereby supplying the thermal needs of the cracking reaction which is endothermic.

Particular examples of such catalytic cracking processes are disclosed in U.S. Pat. Nos. 3,617,497, 3,894,932, 4,309,279 and 4,368,114 (single risers) and 3,748,251, 3,849,291, 3,894,931, 3,894,933, 3,894,934, 3,894,935, 3,926,778, 3,928,172, 3,974,062 and 4,116,814 (multiple risers). Several of these processes employ a mixed catalyst system with each component of the system possessing different catalytic properties and functions. For example, in the dual riser hydrocarbon conversion process described in aforesaid U.S. Pat. No. 3,894,934, a heavy hydrocarbon first feed, e.g., a gas oil, is cracked principally as a result of contact with a large pore crystalline silicate zeolite cracking catalyst, e.g., zeolite Y, to provide lighter products. Spent catalyst is separated from the product stream and enters the' dense fluid catalyst bed in the lower section of the stripping vessel. A $C_{3-4}$ olefin-rich second feed, meanwhile, undergoes conversion to cyclic and/or alkylaromatic hydrocarbons in a second riser, principally as a result of contact with a shape selective medium pore crystalline silicate zeolite, e.g., zeolite ZSM-5. Spent catalyst recovered from the product stream of the second riser similarly enters the dense catalyst bed within the stripper vessel. U.S. Pat. No. 3,894,934 also features the optional introduction of a $C_3^-$ containing hydrocarbon third feed along with an aromatic-rich charge into the dense fluid bed of spent catalyst above the level of introduction of the stripping gas to promote the formation of alkyl aromatics therein. As desired, the third feed may be light gases obtained from a fluid cracking light ends recovery unit, virgin straight run naphtha, catalytically cracked naphtha, thermal naphtha, natural gas constituents, natural gasoline, reformates, a gas oil, or a residual oil of high coke-producing characteristics.

U.S. Pat. No. 3,894,935 describes a dual riser fluid catalytic cracking process in which a gas oil is catalytically cracked in a first riser in the presence of a faujasite-type zeolite such as zeolite Y to provide gasoline boiling-range material and a $C_{3-4}$-rich hydrocarbon fraction or isobutylene is converted in a second riser in the presence of hot regenerated catalyst or catalyst cascaded thereto from the first riser to provide aromatics, alkyl aromatics and low boiling gaseous material It is known to upgrade hydrogen-deficient heavy hydrocarbon feedstocks such as gas oils, resid, syncrudes, etc., to more valuable products by thermal and catalytic cracking operations in admixture with a hydrogen donor diluent material. The hydrogen donor diluent is hereby defined as a material, which releases hydrogen to a hydrogen deficient oil in a thermal or catalytic cracking operation.

One advantage of a hydrogen donor diluent operation is that it can be relied upon to convert heavy oils or hydrogen deficient oils at relatively high conversions in the presence of catalytic agents with reduced coke formation. Coke as formed during the cracking operation is usually a hydrocarbonaceous material sometimes referred to as a polymer of highly condensed, hydrogen-poor hydrocarbons.

Catalytic cracking systems in current operation, e.g., those referred to above, have taken advantage of new catalyst developments, that is, the use of large pore crystalline silicate zeolite cracking catalysts in preference to the earlier use amorphous silica-alumina cracking catalysts. These new crystalline zeolite cracking catalysts, e.g., zeolites X and Y, are generally regarded as low coke producing catalysts. Thus, as the level of coke deposits has been reduced through the use of crystalline zeolite cracking catalysts, it has been equally important to concentrate on recovering the maximum amount of heat available through the burning of deposited coke in the regenerator. However, when operating a catalytic cracking process within optimum conditions provided by the crystalline zeolite conversion catalysts, the petroleum refiner is still faced with operating a hydrogen-deficient process which does not permit the most optimistic recovery of desired products.

In accordance with the hydrocarbon conversion process described in U.S. Pat. No. 4,035,285, a low molecular weight carbon-hydrogen contributing material and a high molecular weight feedstock, e.g., a gas oil, are combined and reacted in the presence of one or more crystalline silicate zeolite catalysts, e.g., zeolite Y, in admixture with ZSM-5, the resulting cracking and carbon-hydrogen additive reactions producing products of improved quality and superior to those formed in the absence of the low molecular weight carbon-hydrogen contributing material. Advantages of the process include improved crackability of heavy feedstocks, increased gasoline yield and/or higher gasoline quality (including octane and volatility), and fuel oil fractions of improved yield and/or burning quality and lower levels of potentially polluting impurities such as sulfur and nitrogen. In addition, the need for high pressure hydrotreaters and hydrocrackers using relatively expensive molecular hydrogen-rich gas can be eliminated or the severity requirements of the operation greatly decreased.

A similar process in which full range crude oils and naphtha are catalytically cracked in the presence of such low molecular weight carbon-hydrogen contributing material and zeolites in separate risers of a multiple riser catalytic cracking unit is described in U.S. Pat. No. 3,974,062 referred to supra.

SUMMARY OF THE INVENTION

It is an object of the present invention to provide a multiple, e.g., dual, riser fluid catalytic cracking process employing a mixed catalyst composition comprising, as a first catalyst component, an amorphous cracking catalyst and/or a large pore crystalline cracking catalyst, e.g., a zeolite such as zeolite X, Y, REY, USY, RE-USY and mixtures/blends thereof, and, as a second catalyst component, a shape selective medium pore crystalline silicate zeolite catalyst, e.g., ZSM-5, ZSM-11, ZSM-12, ZSM-23, ZSM-35, ZSM-38, ZSM-48, etc.

It is another object of the invention to catalytically crack a gas oil and/or other heavy hydrocarbon charge in a first riser in the presence of the foregoing mixed catalyst composition to provide gasoline boiling range material and one or more light hydrocarbons, e.g., a mixture of $C_{1-5}$ aliphatic hydrocarbons and to catalytically crack a thermally treated resid and/or other thermally treated heavy hydrocarbon feed in a second riser in the presence of the mixed catalyst system and in admixture with a gasiform material contributing mobile hydrogen species and/or carbon-hydrogen fragments at the reaction conditions employed, e.g., light hydrocarbon(s) recovered from both the first and second riser, to provide gasoline boiling range material in increased yield and/or of higher quality (including octane and volatility).

It is a particular object of the invention to catalytically crack a resid and/or other heavy hydrocarbon feed which has been subjected to visbreaking prior to introduction to the second riser of the foregoing dual riser catalytic cracking operation.

In keeping with these objects, there is provided a catalytic cracking process which comprises:

(a) cracking a first heavy hydrocarbon feed in a first riser in the presence of a mixed catalyst composition comprising, as a first catalyst component, an amorphous cracking catalyst and/or a large pore crystalline cracking catalyst and, as a second catalyst component, a shape selective medium pore crystalline silicate zeolite, to provide gasoline boiling range material and one or more light hydrocarbons; and, (b) cracking a thermally treated second heavy hydrocarbon feed in a second riser in the presence of said mixed catalyst composition and in admixture with a gasiform material contributing mobile hydrogen species and/or carbon-hydrogen fragments at the reaction conditions employed to provide gasoline boiling range material in increased yield and/or of higher quality.

The term "catalyst" as used herein shall be understood to apply not only to a catalytically active material but to one which is composited with a suitable matrix component which may or may not itself be catalytically active.

In contrast to the processes of U.S. Pat. Nos. 3,974,062 and 4,035,285 referred to above which make no provision for thermally treating a heavy hydrocarbon feed prior to its introduction to the catalytic cracking reaction zone, the process of this invention requires that the second heavy hydrocarbon feed, e.g., a resid, be thermally treated, e.g., by visbreaking, prior to admixture with the low molecular weight carbon-hydrogen contributing material. Thermal pretreatment of the second heavy hydrocarbon feed has the beneficial result of significantly enhancing the reactivity and susceptibility of the feed for adding low molecular weight carbon-hydrogen fragments. Thus, in turn, promotes catalytic cracking of the feed in the second riser to products which contribute to gasoline boiling range material.

BRIEF DESCRIPTION OF THE DRAWING

The attached FIGURE of drawing illustrates a dual riser fluidized catalytic cracking process in accordance with this invention.

DESCRIPTION OF THE PREFERRED EMBODIMENTS

Conventional cracking catalyst components are generally amorphous silica-alumina and crystalline silica-alumina. Other materials said to be useful as cracking catalysts are the crystalline silicoaluminophos-phates of U.S. Pat. No. 4,440,871 and the crystalline metal aluminophosphates of U.S. Pat. No. 4,567,029.

However, the major conventional cracking catalysts presently in use generally comprise a large pore crystalline silicate zeolite, generally in a suitable matrix component which may or may not itself possess catalytic activity. These zeolites typically possess an average crystallographic pore dimension of about 7.0 angstroms and above for the major pore opening. Representative crystalline silicate zeolite cracking catalysts of this type include zeolite X (U.S. Pat. No. 2,882,244), zeolite Y (U.S. Pat. No. 3,130,007), zeolite ZK-5 (U.S. Pat. No. 3,247,195), zeolite ZK-4 (U.S. Pat. No. 3,314,752), merely to name a few, as well as naturally occurring zeolites such as chabazite, faujasite, mordenite, and the like. Also useful are the silicon-substituted zeolites describes in U.S. Pat. No. 4,503,023. Zeolite Beta is yet another large pore crystalline silicate which can constitute a component of the mixed catalyst system utilized herein.

It is, of course, within the scope of this invention to employ two or more of the foregoing amorphous and/or large pore crystalline cracking catalysts as the first catalyst component of the mixed catalyst system. Preferred crystalline zeolite components of the mixed catalyst system herein include the natural zeolites mordenite and faujasite and the synthetic zeolites X and Y with particular preference being accorded zeolites Y, REY, USY and RE-USY or mixtures thereof.

The shape selective medium pore crystalline silicate zeolite catalyst constituting the second catalyst component of the mixed catalyst system is exemplified by ZSM-5, ZSM-11, ZSM-12, ZSM-23, ZSM-35, ZSM-38, ZSM-48 and other similar materials. U.S. Pat. No. 3,702,886 describing and claiming ZSM-5 is incorporated herein by reference. Also, U.S. Pat. No. Re. 29,948 describing and claiming a crystalline material with an X-ray diffraction pattern of ZSM-5 is incorporated herein by reference as is U.S. Pat. No. 4,061,724 describing a high silica ZSM-5 referred to as "silicalite" therein.

ZSM-11 is more particularly described in U.S. Pat. No. 3,709,979, the entire contents of which are incorporated herein by reference.

ZSM-12 is more particularly described in U.S. Pat. No. 3,832,449, the entire contents of which are incorporated herein by reference.

ZSM-23 is more particularly described in U.S. Pat. No. 4,076,842, the entire contents of which are incorporated herein by reference.

ZSM-35 is more particularly described in U.S. Pat. No. 4,016,245, the entire contents of which are incorporated herein by reference.

ZSM-38 is more particularly described in U.S. Pat. No. 4,046,859, the entire contents of which are incorporated herein by reference.

ZSM-48 is more particularly described in U.S. Pat. No. 4,375,573, the entire contents of which are incorporated herein by reference.

The preferred shape selective crystalline silicate zeolites of the mixed catalyst system herein are ZSM-5, ZSM-11, ZSM-12, ZSM-23, ZSM-35, ZSM-38 and ZSM-48 with ZSM-5 being particularly preferred.

The zeolites suitable for use in the present invention can be modified in activity by dilution with a matrix component of significant or little catalytic activity. It may be one providing a synergistic effect as by large molecule cracking, large pore material and act as a coke sink. Catalytically active inorganic oxide matrix material is particularly desired because of its porosity, attrition resistance and stability under the cracking reaction conditions encountered particularly in a fluid catalyst cracking operation.

The catalytically active inorganic oxide may be combined with a raw or natural clay, a calcined clay, or a clay which has been chemically treated with an acid or an alkali medium or both. The matrix component is combined with the crystalline silicate in such proportions that the resulting product contains up to about 50% by weight of the silicate material and preferably from about 0.5% up to about 25 weight percent thereof may be employed in the final composite.

In general, the aluminosilicate zeolites are effectively employed herein. However, zeolites in which some other framework element which is present in partial or total substitution of aluminum can be advantageous. For example, such catalysts may provide a higher conversion of feed to aromatic components, the latter tending to increase the octane, and therefore the quality, of the gasoline produced in the process. Illustrative of elements which can be substituted for part or all of the framework aluminum are boron, gallium, zirconium, titanium and, other trivalent metals which are heavier than aluminum. Specific examples of such catalysts include ZSM-5 and zeolite Beta containing boron, gallium, zirconium and/or titanium. In lieu of, or in addition to, being incorporated into the zeolite framework, these and other catalytically active elements can also be deposited upon the zeolite by any suitable procedure, e.g., impregnation. Thus, the zeolite can contain a hydrogen-activating function, e.g., a metal function such as platinum, nickel, iron, cobalt, chromium, thorium (or other metal function capable of catalyzing the Fischer-Tropsch or water-gas shift reactions) or rhenium, tungsten, molybdenum (or other metal function capable of catalyzing olefin disproportionation).

The expression "low molecular weight carbon-hydrogen contributing material" as used herein contemplates materials comprising a lesser number of carbon atoms than that found in materials within the gasoline boiling range and preferably includes those materials containing 5 or less carbon atoms which fit into any of the following categories of:

a. Hydrogen-rich molecules, i.e. molecules containing about 12 to about 25 weight percent hydrogen. This may include light paraffins, e.g. $CH_4$, $C_2H_6$, $C_3H_8$, light virgin naphtha and other materials.

b. A hydrogen donor molecule, i.e. a molecule whose chemical structure permits or favors intermolecular hydrogen transfer. This includes $CH_3OH$, other low boiling alcohols such as ethanol, n-propanol, isopropanol, n-butanol, isobutanol, etc., aliphatic ethers, other oxygen compounds (acetals, aldehydes, ketones) certain sulfur, nitrogen and halogenated compounds. These would include $C_2$-$C_5$ aliphatic mercaptans, disulfides, thioethers, primary, secondary, tertiary amines and alkylammonium compounds, and haloalkanes such as methyl chloride etc.

c. Reactants that chemically combine to generate hydrogen donors or active or nascent hydrogen, i.e. carbon monoxide, CO, especially $CO+H_2O$, $CO+H_2$, CO+alcohol, CO+olefin, etc.

d. Secondary Reaction Products from materials in categories (a), (b), or (c) above that are hydrogen donors themselves, or transfer hydrogen, or become involved in intermolecular hydrogen transfer in which hydrogen redistribution occurs. This includes olefins, naphthenes, or paraffins.

e. Classes of materials which are structurally or chemically equivalent to those of category (d), notably olefins, etc.

f. A combination of any or all of the materials in categories (a) through (e).

The mobile hydrogen component of the reaction mixture of the present invention may be provided from several different sources, such as the high molecular weight feed and the low molecular weight material, it being preferred to obtain hydrogen moieties from gasiform and vaporous component materials occurring in the operation lower boiling than the hydrocarbon material charged to the cracking operation. Thus, it is proposed to obtain the hydrogen moieties suitable for hydrogen distribution reactions from component and component mixtures selected from the group comprising methanol, dimethylether, CO and water, carbon monoxide and hydrogen, $CH_2SH$, $CH_3NH_2$, $(CH_3)_2NH$, $(CH_3)_3N$ and $CH_3X$, where X is a halide such as fluorine, bromine, chlorine and iodine. Of these hydrogen contributing materials it is preferred to use methanol alone or in combination with either CO and water together. On the other hand, it is contemplated combining light olefinic gaseous products found in pyrolysis gas and the products of catalytic cracking such as ethylene, propylene and butylene with the hydrogen contributing material and/or carbon hydrogen contributing material. In any of these combinations, it is preferred that the mobile hydrogen or the carbon-hydrogen fraction be the product of one or more chemical reactions particularly promoted by the shape selective medium pore crystalline silicate zeolite.

Suitable charge stocks for cracking in each riser comprise the heavy hydrocarbons generally and, in particular, petroleum fractions having an initial boiling point range of at least about 400° F., a 50% point range of at least about 500° F. and an end point range of at least about 600° F. Such hydrocarbon fractions include gas oils, thermal oils, residual oils, cycle stocks, whole top crudes, tar sand oils, shale oils, synthetic fuels, heavy hydrocarbon fractions derived from the destructive hydrogenation of coal, tar, pitches, asphalts, hydrotreated feedstocks derived from any of the foregoing, and the like. In short, any hydrogen-deficient feedstock and preferably one which would require a more conventional high pressure hydrocracking and hydrotreating operation to render the feed suitable for use in a fluid catalytic cracking operation can be used in the process of this invention.

Visbreaking, or viscosity breaking, is a preferred procedure for thermally treating the second heavy hydrocarbon feed prior to its introduction to the second riser. Visbreaking is a well known petroleum refining process in which reduced crudes are pyrolyzed, or cracked, under comparatively mild conditions to provide products having lower viscosities and pour points. In a typical visbreaking process, the heavy hydrocarbon feed, e.g., a resid, is passed through a heater and heated from about 425° to about 600° C. at about 450 to about 7000 kPa. Examples of such visbreaking methods are described in Beuther et al., "Thermal Visbraking of Heavy Residues," *The Oil and Gas Journal,* 57:46, Nov. 9, 1959, pp. 151–157; Rhoe et al., "Visbreaking: A Flexible Process," *Hydrocarbon Processing,* January 1979, pp., 131–136; and U.S. Pat. No. 4,233,138, the contents of which are incorporated by reference herein.

Referring now to the FIGURE of drawing, a heavy virgin gas oil feed, optionally one which has been hydrotreated, e.g., with process hydrogen, is introduced to the cracking unit by conduit 2 where it is combined with hot regenerated catalyst comprising zeolite Y in admixture with ZSM-5 in conduit 4 containing flow control valve 6 to form a suspension of catalyst particles in oil vapors which pass upwardly through first riser reactor 8. The conversion conditions within first riser 8 can be varied depending upon whether it is desired to maximize production of naphtha or light hydrocarbons, principally $C_2$–$C_4$ olefinic hydrocarbons. When it is desired to emphasize the production of naphtha, the ZSM-5 zeolite in the catalyst mixture can represent from about 0.01 to about 10, and preferably from about 0.1 to about 5 weight percent of the catalyst mixture and the temperature can +range from about 900° to about 1150° F. and preferably from about 925° to about 1000° F., the catalyst to feed ratio can range from about 2:1 to about 20:1 and preferably from about 4:1 to about 10:1 and the catalyst contact time can range from about 0.5 to about 30 seconds and preferably from about 1 to about 15 seconds. When, however, light hydrocarbon production (at the expense of naphtha) is desired, the ZSM-5 zeolite in the catalyst mixture can comprise from about 0.5 to about 25, and preferably from about 1 to about 10, weight percent of the catalyst mixture, the temperature, catalyst to oil ratio and catalyst contact time being selected from the aforementioned ranges. During passage of the suspension through the riser, conversion of the gas oil feed to lower and higher boiling products occurs. These products are separated after removal of catalyst therefrom in a cyclone separator 10 housed in the upper portion of vessel 12. Separated hydrocarbon vapors pass into plenum chamber 14 and are removed therefrom by conduit 16 for separation in downstream operations. Catalyst separated in cyclone 10 is conveyed by dipleg 18 into a bed of catalyst 20 therebelow. In fractionation zone 56, a separation of the products of conversion from riser 8 is made to recover main column bottoms (MCB) by conduit 59 communicating with conduit 2 for recycle to riser 8 as desired. On the other hand, the MCB may be withdrawn by conduit 60 for other use. A heavy cycle oil (HCO) is withdrawn by conduit 62 for recycle by conduit 59 to riser 8. A light cycle oil (LCO) product is withdrawn by conduit 64. An overhead fraction lower boiling than the light cycle oil and comprising gasoline and lower boiling hydrocarbons are withdrawn from an upper portion of fractionator 56 by conduit 66. The withdrawn material in conduit 66 passes through cooler 68 and conduit 70 to knockout drum 72 wherein condensed liquids such as water and gasoline boiling material are separated from lower boiling gaseous components. The low boiling gaseous components are withdrawn by conduit 74 for passage to a light ends recovery operation 75 wherein a separation is made to recover, for example, light hydrocarbons such as $C_{1-5}$ paraffins and $C_{2-5}$ olefins. A gasoline boiling range fraction separated in drum 72 is recycled by conduit 57 as reflux to the fractionator tower.

Hot freshly regenerated catalyst is passed to the inlet of second riser 30 by conduit 26 equipped with valve means 27. A source of carbon-hydrogen fragments, e.g., one or more hydrocarbons from light ends recovery operation 75, is introduced by conduit 28 to a lower region 29 of second riser 30 for admixture with the catalyst to form a suspension. The conditions in lower section 29 include a temperature of from about 1100° to about 1500° F. and preferably from about 1250° to about 1350° F., a catalyst to feed ratio of from about 50:1 to about 200:1 and preferably from about 100:1 to about 150:1 and a catalyst contact time of from about 10 to about 50 seconds.

As the catalyst-hydrocarbon suspension formed in lower region 29 of second riser 30 continues to ascend therein, it enters an upper region 31 wherein it is combined with a thermally treated resid feed, e.g., one which has been previously treated by visbreaking in a conventional or otherwise known manner prior to its introduction to the riser through conduit 80. As a result of the visbreaking treatment, the thermally treated resid is rendered significantly more reactive and tends to pick up hydrocarbon fragments far more readily than it would in the absence of such treatment. Temperature control within upper region 31 of riser 30 and other factors influencing the nature of the conversion occurring therein can be controlled by adjusting the quantity of stripped, non-regenerated catalyst mixture introduced therein through conduit 33 provided with control valve 34 and cooler 35. Depending upon its temperature, the catalyst mixture can serve as a quench to reduce the temperature in the upper region of the second riser. In general, lower temperatures favor higher liquid recovery at, however, the expense of octane number of the gasoline product. Conversely, higher temperature favor increased aromatization but greater gas production (e.g., hydrogen, methane and some other light paraffins) with consequent lower liquid recovery but with a beneficial increase in the octane number of the gasoline product. In general, the temperature within upper region 31 of riser 30 can be maintained within the range of from about 950° to about 1150° F., preferably from about 1000° to about 1100° F., a catalyst to feed ratio of from about 3:1 to about 10:1, preferably from about 4:1 to about 8:1 and a catalyst contact time of from about 0.5 to about 10 seconds, preferably from about 1 to about 5 seconds. The hydrocarbon product/catalyst stream continues upwardly within riser 30 to be discharged into cyclone separator 36 provided with dipleg 37 in the upper portion of vessel 12.

Catalyst discharged from diplegs 18 and 37 is collected in the lower portion of vessel 12 as a fluid bed of catalyst particles 20 moving generally downwardly through the vessel and through a stripping zone provided in the lowermost portion of vessel 12. Stripping gas, e.g., steam, is added to the lower portion of the stripping zone by conduit 38. The products of conversion from riser 30 are passed to plenum chamber 14 and are removed therefrom by conduit 16 communicating with a conventional product recovery unit as previously described.

The products of conversion from riser 30 are passed to plenum chamber 15 and are removed therefrom by conduit 54 communicating with a conventional product recovery unit 56.

Catalyst particles comprising particularly the zeolite Y cracking component of the mixed catalyst system herein accumulate a relatively high level of entrained hydrocarbonaceous material therein which is subsequently removed by regeneration with oxygen-containing regeneration gases in a catalyst regeneration unit (not shown) of known design and operation.

Having thus provided a general discussion of the present invention and described specific embodiments in support thereof, it is to be understood that no undue restrictions are to be imposed by reason thereof except as provided by the following claims.

What is claimed is:

1. A catalytic cracking process which comprises:

(a) cracking a gas oil in a first riser in the presence of a mixed cataylst composition comprising, as a first catalyst component, at least one member of the group of amorphous cracking catalyst and large pore crystalline cracking catalyst and as a second catalyst component, a shape selective zeolite, at a mixed catalyst to feed ratio from about 2:1 to about 20:1 and a temperature from about 900° to 1150° F. to produce cracked products comprising $C_1$ to $C_5$ hydrocarbons, gasoline boiling range materials and spent catalyst, and stripping at least a portion of spent catalyst to produce stripped catalyst which is regenerated in a catalyst regeneration zone to produce hot, regenerated catalyst;

(b) generating in a lower region of a second riser reactor at least one of mobile hyrogen species and carbon-hydrogen fragments by contacting a stream of light hydrocarbons with hot regenerated catalyst at a catalyst to feed ratio of about 50:1 to 200:1 and at a temperature of about 1100° to 1500° F. to form a catalyst-hydrocarbon suspension comprising carbon-hydrogen fragments, which suspension is discharged into an upper region of said second riser;

(c) adding a visbroken resid feed to said upper region to contact the catalyst-hyrocarbon suspension discharged from the lower region of the second riser and reacting said visbroken resid in the presence of said mixed catalyst composition under conditions effecting cracking and additive carbon-hydrogen reactions with said resid and forming a resid-catalyst mixture;

(d) quenching said resid-catalyst mixture in said second riser by adding thereto a portion of said spent catalyst, discharged from said first riser to produce a quenched resid-catalyst mixture having a temperature of about 950° to 1150° F. and discharging from said second riser a mixture of catalytically cracked products and spent catalyst.

2. The process of claim 1 wherein the visbroken second heavy hydrocarbon feed and the gasiform material are reacted in the presence of said mixed catalyst composition under conditions affecting cracking and additive carbon-hydrogen reactions to produce products of a quality improved over those formed in the absence of said added gasiform material.

3. The process of claim 1 wherein the gasiform material comprises one or more $C_1$ to $C_5$ hydrocarbons recovered from the process.

4. The process of claim 1 wherein thermal treatment of the second heavy hydrocarbon feed is by visbreaking.

5. The process of claim 1 wherein the first catalyst component is a large pore crystalline silicate zeolite.

6. The process of claim 1 wherein the first catalyst component is a large pore crystalline silicate zeolite selected from the group consisting of zeolite X, Y, REY, USY, RE-USY, mordenite and/or mixtures thereof and the second catalyst component is selected from the group consisting of ZSM-5, ZSM-11, ZSM-12, ZSM-23, ZSM-35, ZSM-38 and ZSM-48.

7. The process of claim 6 in which the second catalyst component contains at least one element selected from the group consisting of boron, gallium, zirconium and titanium in the framework structure thereof and/or deposited thereon.

8. The process of claim 6 wherein, in the first riser, the zeolite concentration of the second catalyst component represents from about 0.01 to about 10 weight percent of the total catalyst mixture, the temperature is within the range of from about 900° to about 1150° F., the catalyst to oil ratio is from about 2:1 to about 20:1 and the catalyst contact time is from about 0.5 to about 30 seconds.

9. The process of claim 6 wherein, in the first riser, the zeolite concentration of the second catalyst component represents from about 0.1 to about 5.0 weight percent of the total catalyst mixture, the temperature is within the range of from about 925° to about 1000° F., the catalyst to oil ratio is from about 4:1 to about 10:1 and the catalyst contact time is from about 1 to about 15 seconds.

10. The process of claim 1 wherein, in the first riser, the zeolite concentration of the second catalyst component represents from 0.5 to about 25 weight percent of the total catalyst mixture, to 1150° F., the catalyst:oil ratio is from 2:1 to 20:1 and the catalyst contact time is from 0.5 to about 30 seconds.

11. The process of claim 6 wherein, in the first riser, the zeolite concentration of the second catalyst component represents from about 1 to about 10 weight percent of the total catalyst mixture, the temperature is within the range of from about 925° F. to about 1000° F., the catalyst:oil ratio is from about 4:1 to about 10:1 and the catalyst contact time is from about 1 to about 15 seconds.

12. The process of claim 6 wherein, in the lower region of the second riser, the temperature is within the range of from about 1100° to about 1500° F., the catalyst to oil ratio is from about 50:1 to about 200:1 and the catalyst contact time is from about 10 to about 50 seconds.

13. The process of claim 6 wherein, in the lower region of the second riser, the temperature is within the range of from about 1250° to about 1350° F., the catalyst to oil ratio is from about 100:1 to about 150:1 and the catalyst contact time is from about 15 to about 35 seconds.

14. The process of claim 6 wherein, in the upper region of the second riser, the temperature is within the range of from about 950° to about 1150° F., the total catalyst to hydrocarbon ratio is from about 3:1 to about 10:1 and the catalyst contact time is from about 0.5 to about 10 seconds.

15. The process of claim 6 wherein, in the upper region of the second riser, the temperature is within the range of from about 1000° to about 1100° F., the total catalyst to hydrocarbon ratio is from about 4:1 to about 8:1 and the catalyst contact time is from about 1 to about 5 seconds.

16. The process of claim 1 wherein the first heavy hydrocarbon feed is subjected to hydrotreatment prior to its introduction in the first riser.

17. The process of claim 16 wherein the hydrotreatment utilizes process hydrogen.

18. The process of claim 1 wherein cracking step (a) is also carried out in the presence of a gasiform material contributing mobile hydrogen species and/or carbon-hydrogen fragments at the reaction conditions employed.

19. The process of claim 1 wherein the first and/or second catalyst component contains a hydrogen-activating function.

20. The process of claim 6 wherein the first and/or second catalyst component contains a hyrogen-activating function.

* * * * *